United States Patent [19]

Jacob

[11] Patent Number: 5,053,081

[45] Date of Patent: Oct. 1, 1991

[54] COMPOSITION AND METHOD FOR TREATMENT OF CONVERSION COATED METAL SURFACES WITH AN AQUEOUS SOLUTION OF 3-AMINOPROPYLTRIETHOXY SILANE AND TITANIUM CHELATE

[75] Inventor: Savarimuthu M. Jacob, Edison, N.J.

[73] Assignee: Oakite Products, Inc., Berkeley Heights, N.J.

[21] Appl. No.: 503,321

[22] Filed: Apr. 2, 1990

[51] Int. Cl.[5] ..... C09K 3/00; B05D 3/02

[52] U.S. Cl. ..... 106/287.11; 106/287.19; 427/388.1; 427/388.4; 427/387

[58] Field of Search ..... 427/388.4, 388.1; 106/287.11, 287.19

[56] References Cited

U.S. PATENT DOCUMENTS

| | | | |
|---|---|---|---|
| 3,101,277 | 4/1959 | Eder et al. | 427/388.4 |
| 3,832,203 | 8/1974 | Saunders et al. | 106/287.11 |
| 3,832,204 | 8/1974 | Boaz | 106/287.11 |
| 4,311,738 | 1/1982 | Chi | 427/387 |
| 4,362,783 | 12/1982 | Graham | 428/447 |
| 4,495,156 | 1/1985 | Rohowetz | 106/287.19 |
| 4,546,017 | 10/1985 | Flackett et al. | 427/387 |
| 4,656,097 | 4/1987 | Claffey et al. | 427/409 |
| 4,680,364 | 7/1987 | Lucas | 427/387 |
| 4,689,085 | 8/1987 | Plueddemann | 106/287.19 |
| 4,746,366 | 5/1988 | Phillipp et al. | 106/287.19 |
| 4,749,741 | 6/1988 | Saito et al. | 524/859 |
| 4,814,017 | 3/1989 | Yoldas et al. | 106/287.19 |
| 4,900,362 | 2/1990 | Fujuki et al. | 106/287.19 |

FOREIGN PATENT DOCUMENTS

| | | | |
|---|---|---|---|
| 585525 | 10/1959 | Canada | 106/287.19 |
| 4923232 | 3/1974 | Japan | 106/287.19 |

OTHER PUBLICATIONS

Japanese Patent Disclosure Bulletin No. 59-219478, Saito et al. (12/84).

*Primary Examiner*—Michael Lusignan
*Assistant Examiner*—Diana L. Dudash
*Attorney, Agent, or Firm*—Dann, Dorfman, Herrell and Skillman

[57] ABSTRACT

A final rinse composition, for enhancing the siccative coating adhesion and corrosion resistance properties of conversion coated metal surfaces, comprising an aqueous solution of a selected organosilane and a selected organotitanate, and a method of use thereof.

9 Claims, No Drawings

COMPOSITION AND METHOD FOR TREATMENT OF CONVERSION COATED METAL SURFACES WITH AN AQUEOUS SOLUTION OF 3-AMINOPROPYLTRIETHOXY SILANE AND TITANIUM CHELATE

BACKGROUND OF THE INVENTION

This invention relates to the preparation of metal surfaces for finishing operations, especially the application of siccative finishes. More particularly, this invention relates to a final rinse for conversion coated metal surfaces, comprising an aqueous solution of a selected organosilane and a selected organotitanate, which enhances the adhesion of siccative coatings, and imparts improved corrosion resistance to such surfaces.

The surfaces of metal articles are commonly coated with siccative finishes for a variety of reasons including protection of the metal from corrosion and for aesthetic purposes. However, it is well-known that many organic and inorganic siccative coatings do not adhere well to the surfaces of articles made from metals (for example, iron, steel, aluminum, and zinc and their alloys) in the raw state, thereby degrading the corrosion inhibiting and aesthetic benefits of such coatings. To alleviate this problem, such surfaces are routinely treated with a "conversion coating" prior to the application of a siccative finish. The conversion coating acts as an adherent base for a subsequent siccative coating and also, in cooperation with the siccative coating, acts to inhibit corrosion of the metal surface. Such conversion coatings are well-known in the art and thus will not be described in detail.

When used alone, conversion coatings often provide less than acceptable levels of siccative coating adhesion and corrosion resistance. These properties are often improved upon by the subsequent application of a "final rinse", also termed a "post-treatment". Of the final rinses used heretofore, those usually considered most effective in improving the siccative coating adhesion and corrosion resistance properties of metallic surfaces generally contain chromic acid or other chromium-containing compounds. It has become well-known, however, that hexavalent and trivalent chromium compounds are hazardous and toxic. Consequently, solutions containing such chromium compounds present difficult handling problems in use. Also, they are currently prohibited by law from being introduced into natural waters or public sewage systems, and are therefore difficult and expensive to dispose of in an environmentally acceptable manner. For these reasons, substantial efforts have been directed toward the development of non-toxic, or less toxic, chromium-free final rinse solutions. These efforts have resulted in a wide variety of well-known chromium-free final rinses, having either organic or inorganic compositions.

Organofunctional silanes, also known as organosilanes, are widely used in various industries in diverse applications. Compounds of this class are primarily used as corrosion inhibitors, coupling compounds, or as adhesion promoters to enhance the bonding of organic coatings, including polymeric coatings, to metal, glass, or polymeric surfaces. Organosilanes have been utilized in final rinse solutions for the post-treatment of conversion coatings. For example, Japanese Patent Application No. 59-93188 (Public Patent Disclosure Bulletin 59-219478 Dated Dec. 10, 1984) describes a post-treatment agent for metal surfaces comprising an aqueous solution in which the active ingredient is an organoalkoxysilane. Metal surfaces treated with such solutions are described as having improved corrosion resistance and siccative coating adhesion. According to this disclosure, the organoalkoxysilanes which may be employed include those whose reactive organic functional groups comprise a carbon-carbon double bond (e.g., vinyltrimethoxysilane and vinyltriethoxysilane), an epoxy group (e.g., 3-glycidoxypropyltrimethoxysilane), or an amino group (e.g., (2-aminoethyl) aminopropyltrimethoxysilane).

Polyfunctional organotitanates have a variety of well-known industrial uses including catalysis, polymer cross-linking, and surface modification. Such organotitanates have also been compounded with various silicon compounds, including organosilanes, for use on coating compositions. For example, U.S. Pat. No. 4,746,366, issued to G. Philipp et al. on May 24, 1988, describes a lacquer which has been obtained by the hydrolytic precondensation of: (a) at least one titanium or zirconium compound of the formula $$MR_4$$

in which M denotes titanium or zirconium and R represents halogen, hydroxyl, alkoxy, acyloxy, or a chelating ligand, preferably a ligand coordinated to the metal via oxygen and/or nitrogen; and (2) an organosilane. According to this patent, such lacquers, upon hardening by heating or exposure to ultraviolet radiation, produce scratch-resistant coatings suitable for use on a variety of substrates. Such coatings are described as providing particularly advantageous results when applied to scratch-sensitive plastics, including, for example, spectacle lenses.

U.S. Pat. No. 4,749,741, issued to M. Saito et al. on June 7, 1988, discloses a primer composition for cohesively bonding silicon rubbers to plastics and metals. This composition is comprised of: (a) an organotitanate ester; (b) optionally, either (1) an organosilicon compound or (2) an organohydrogensilane or an organohydrogenpolysiloxane; and (c) a quantity of organic liquid sufficient to solubilize the composition. The organotitanate ester has the general formula $$[HC(R^1)=C(R^2)CO(O)]_l\ Ti[OC(O)R^3]_m(OR^4)_n$$

wherein $R^1$ and $R^2$ individually represent a hydrogen atom or an alkyl radical; $R^3$ and $R^4$ represent identical or different alkyl or aryl radicals; $l=1, 2,$ or $3$; $m=0, 1, 2,$ or $3$; $n=0, 1, 2,$ or $3$; and $l+m+n=4$. In the foregoing organotitanate ester, the titanium atom must be bonded to at least one residue resulting from the removal of a hydrogen atom from the carboxyl group of an ethylenically unsaturated monocarboxylic acid such as acrylic or methacrylic acid. The optional organosilicon compound has at least 2 silicon-bonded alkoxy groups in each molecule and has the average unit formula $$R^5_u\ R^6_v(OR^7)_wSiO_{(4-u-v-w)/2}$$

while the alternative optional component, which is either an organohydrogensilane or an organohydrogensiloxone, contains at least one silicon bonded hydrogen atom per molecule and has the average unit formula $$H_xR^5_y(OR^7)_z\ SiO_{(4-x-y-z)/2}$$

where $R^5$ represents a substituted or unsubstituted monovalent hydrocarbon radical exclusive of the substituents represented by $R^6$; $R^6$ represents a monovalent organic group containing an addition-reactive or condensation-reactive functional group; $R^7$ represents an alkyl, aryl or alkoxyalkyl radical; the values of u and v are identical or different and are within the range of from 0 to 3, inclusive, the value of w is greater than 0 up to and including 4, the sum of u and v and w is greater than 0 up to and including 4, the value of x is from 1 up to but not including 3, the value of y is from 0 up to but not including 3, the value of z is from 0 to 3, inclusive, and the sum of x+y+z is greater than 0 up to and including 4.

A commercial product, comprising an organosilane and morpholine, or a morpholine-based derivative, is available for use as a final rinse for conversion coated metal surfaces.

The degree of siccative coating adhesion and corrosion resistance provided by such known compositions generally fails to achieve the highly desirable levels of those properties which are exhibited by chromium-based final rinses. Also, some of the known compositions are less than completely compatible with certain types of coatings or paints, resulting in undesirable blistering, cracking, peeling or chipping of the finish coat. Recently, I have discovered that an aqueous solution containing a selected organosilane and a selected organotitanate, when used as a final rinse on conversion coated metal surfaces, provides such surfaces with an exceptional degree of siccative finish adhesion and corrosion resistance, which is comparable to chromium-containing final rinses.

SUMMARY OF THE INVENTION

It is therefore an object of this invention to provide a method and a final rinse composition for imparting enhanced siccative coating adhesion and corrosion resistance properties to a conversion coated metal surface.

It is a further object of this invention to provide a chromium-free final rinse composition.

It is a more specific object of this invention to provide a final rinse composition, containing a selected organosilane and a selected organotitanate, which imparts levels of siccative coating adhesion and corrosion resistance comparable to those provided heretofore by chromium-containing final rinses for conversion coated metal surfaces.

This invention provides a method and a final rinse composition for treating a conversion coated metal surface to obtain enhanced corrosion resistance and siccative coating adhesion, said final rinse composition comprising an aqueous solution including a selected organosilane and a selected organotitanate.

DETAILED DESCRIPTION OF THE INVENTION

The composition of the present invention is a final rinse for application on a metal surface to which a conversion coating has been previously applied. The process of conversion coating is a multi-step operation, the specific steps of which may vary depending upon: the siccative finish to be later applied; the type of metal undergoing treatment; and the ultimate result desired. Such conversion coating processes are known in the art and form no part of the invention, and will therefore not be described in detail. Generally, the metal surface to be conversion coated is first cleaned, rinsed, and then treated with the conversion coating. Examples of two familiar primary conversion coating processes are chromating and phosphating. A method of phosphate conversion coating resulting in greater corrosion resistance involves the use of heavy metal ions in a partially neutralized phosphoric acid solution containing accelerators. Zinc phosphate conversion coatings are generally deposited so as to apply between 150 and 1,000 or more milligrams of coating per square foot of the metallic surface while iron phosphate conversion coatings are generally deposited so as to apply between 10 and 100 milligrams of coating per square foot of the metallic surface. A variety of metals including iron, steel, aluminum, aluminum alloys, zinc, zinc alloys, and other nonferrous metals may be conversion coated in this way. It will be understood that any type of conversion coated metal substrate may be treated in accordance with the present invention.

The final rinse composition of the present invention comprises a preferably aqueous solution containing a selected organosilane and a selected organotitanate. More specifically, the present invention comprises an aqueous solution of 3-aminopropyltriethoxysilane and "TYZOR® CLA", a proprietary organic titanium chelate of E. I. duPont de Nemours and Co., 1007 Market Street, Wilmington, Del. 19898. "TYZOR® CLA" is known to be the reaction product of a tetralkyltitanate with a beta-diketone and an alkanolamine. TYZOR CLA® is red amber (77% in alcohol, contains 8.6% titanium and has a specific gravity (25°C./25° C.) of 1.03, viscosity (cP) of about 50 at 25° C., a thickening point of less than −25° C. and a flash point of 13° C. (closed cup), as determined by a Pensky-Martens Closed Tester. More specifically, it is believed that "TYZOR® CLA" is the reaction product of tetraisopropyl titanate, (duPont "TYZOR® TPT")

$[(CH_3)_2CHO]_4\ Ti$ acetylacetone and triethanolamine, resulting in a mixture containing the titanium chelate species $(i\text{-}PrO)_2Ti(acac)_2$ (I) and $(i\text{-}PrO)_2Ti(TEA)_2$ (II).

I

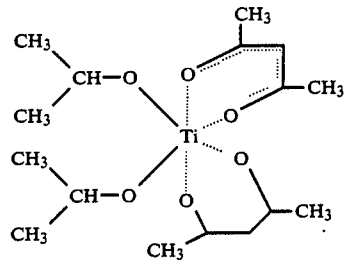

II

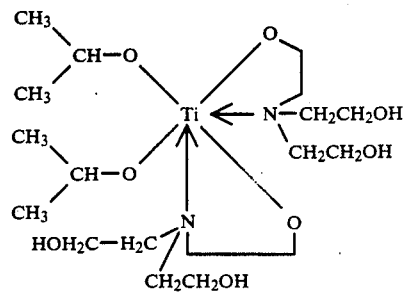

The final rinse composition of the present invention is readily prepared as an aqueous solution having a pH range of about 8–10.5, in which the selected organosilane is present in a concentration of approximately 0.2 to 300 grams/liter (g/l) (about 0.02 to 30 w/o) and the selected organotitanate is present in a concentration of approximately 0.01 to 100 g/l (about 0.001 to 10 w/o). This range of concentrations includes both a concentrated form of the composition for storage or handling, and a dilute form of the composition for application as a final rinse. An especially preferred concentrated form of the composition is an aqueous solution comprising about 8 w/o of the organosilane and about 1 w/o, of the organotitanate. The final rinse solution applied to a conversion coated surface contains the organosilane in a concentration of approximately 0.2 to 50.0 g/l (about 0.02 to 5 w/o), and preferably from about 2.0 to 5.0 g/l (about 0.2 to 0.5 w/o), and contains the organotitanate in a concentration of approximately 0.01 to 20 g/l (about 0.001 to 2 w/o), preferably from about 0.05 to 10 g/l (about 0.005 to 1 w/o). The dilute form of the composition may be conveniently prepared by diluting the aqueous liquid concentrate with water to achieve the desired organosilane/organotitanate concentrations. Generally, the use of solutions having concentrations near the lower end of the above-noted ranges permits the effective preparation and treatment of metal surfaces in accordance with the present invention in the most cost-efficient manner.

The final rinse composition of the invention may be applied to a conversion coated metal surface by immersion, spraying, brushing, rolling, or any other means that causes contact of the conversion coated surface with the composition. The composition, having a pH of about 8–10.5, may be applied to the conversion coated surface at temperatures from approximately 40° to 200° F., preferably from about 60° to 160° F., and for best results from about 100° to 110° F. Following the final rinse the treated metal surface can be dryed in various ways including simple air drying, forced air drying, and oven drying. Once dry, the treated surface is ready for the application of organic or inorganic siccative finishes, e.g., painting. However, the treated surface is capable of withstanding relatively mild or short-term corrosive conditions without further finishing or coating. This is a particularly desirable quality in the case of conversion coated aluminum which is usually not painted or otherwise further finished. As previously noted, the final rinse solution of the present invention may be conveniently prepared by diluting an aqueous liquid concentrate with water.

EXAMPLES

The following examples demonstrate the results obtained using the final rinse composition of the present invention. The inventive composition, Example 1, is shown in Table I. To facilitate comparison, the compositions of several other final rinse formulations (Examples 5–12), used for comparison testing as described hereinbelow, are also given in Table I.

TABLE I

| Ex. No. | Silane | Composition(w/o)[1] Titanate | Other |
|---|---|---|---|
| 1 | 3-aminopropyl-(8.0) triethoxysilane | CLA (0.5)[2] | |
| 2 | 3-glycidyloxy-propyltrimethoxy-silane (8.0) | CLA (0.5) | |
| 3 | vinyltrimethozy-silane (8.0) | CLA (0.5) | |
| 4 | vinyl-tris-(B-methoxyethoxy) silane (8.0) | CLA (0.5) | |
| 5 | 3-aminopropyl-triethoxysilane (10.0) | | morpholine[3] derivative (0.9) |
| 6 | 3-aminopropyl-triethoxysilane (1, D.I. rinse)[4] | | |
| 7 | 3-aminopropyl-triethoxysilane (0.01, no D.I. rinse) | | |
| 8 | | CLA (1.0, D.I. rinse) | |
| 9 | | CLA (0.01, no D.I. rinse) | |
| 10 | | | Chrome[5] (D.I. rinse) |
| 11 | | | Chrome (no D.I. rinse) |
| 12 | N-(2-aminoethyl)-trimethoxysilane (8.0) | CLA (0.5) | |

[1]All Examples shown herein are aqueous solutions.
[2]TYZOR ® CLA-proprietary organic titanium chelate of the duPont Company
[3]Morpholine derivative-Biophen B-1487, available from International Mining and Chemical Co., containing 50% 2-nitrobutylmorpholine and 20% 2-ethyl-2-nitrotrimethylene dimorpholine.
[4]D.I. rinse = followed by deionized water rinse.
[5]Oakite Products, Inc. FH-3.

Throughout this application, unless otherwise indicated, all compositions in percent will be in percent by weight (w/o), based on total weight of the composition.

Final rinses are required to be clear solutions. Preliminary examination of each of the solutions listed in Table I indicated that several combinations of different organosilanes with TYZOR ® CLA, specifically comparative Examples 2, 3, and 4, were undesirably hazy and/or precipitous, and therefore unacceptable as final rinses. Thus, panels fabricated from cold rolled AISI 1010 steel sheet were phosphated with a pH5, 2% solution of Oakite Iron Phosphate at 120° F. for 60 s, and then rinsed with deionized water at ambient temperature. The final rinse composition of Ex. 1, an aqueous solution of about 8 w/o 3-aminopropyltriethoxysilane and about 0.5 w/o TYZOR ® CLA titanate chelate, was applied to the phosphated panels as a 1.5 volume percent (v/o) solution, at 110° F., for 30 s. The treated panels were dryed at about 350° F. for 1–2 min. and then painted with one of the following well-known types of paint: high solids alkyd, polyester, epoxy, or alkyd. Additional cold rolled AISI 1010 steel panels were similarly treated, except that the final rinses of comparative Examples 5–12 were substituted for the final rinse of Example 1. In some instances, as indicated in Table I, a deionized water rinse (D. I. rinse) followed application of the final rinse solution. The "chrome" comparative Examples were treated with Oakite Products, Inc. FH-3, a commercially available chromium-containing final rinse.

Triplicate treated and painted steel specimens were subjected to a standard salt spray corrosion test according to ASTM B-117-85 in order to evaluate the suitability of the Example 1 composition as a final rinse, in comparison with the final rinses of Examples 5–12. Briefly, the surface of each specimen was scored with a scribe sufficiently to break the paint. The specimen was then exposed to a continuous salt spray environment for 120 h., after which time the scribe creepage was measured. Scribe creepage is defined as the distance from the score line that the finish coat has lifted; it is an indicator of the adhesion of a paint or other siccative coating to the final rinse-treated surface. The level of adhesion in turn affects corrosion resistance of the treated metal surface: poor siccative coating adhesion affects the corrosion resistance of the metal surface. According to ASTM B-117-85, creepage in excess of about 1/16 inch (about 2–3 mm) from the scribed line is considered a failure, although some manufacturers will accept creepage of up to about ⅛ inch before considering the specimen a failure. The salt spray corrosion test results for Example 1 and comparative Examples 5–12 are shown in Table II. As may be seen from these results, the final rinse of the present invention (Ex. 1), containing both the selected organosilane and organotitanate, substantially outperforms either the organosilane (Exs. 6&7), or the organotitanate (Exs. 8 &9), alone. It is noteworthy that another organosilane combination with TYZOR ® CLA, Ex. 12, performed poorly in the salt spray test, exhibiting excessive scribe creepage. As is also evident from Table II, the final rinse of the present invention (Ex. 1) approximates the results obtained with the prior art chromium-containing final rinse (Exs. 10&11) and significantly outperforms the commercially available non-chromium final rinse (Ex. 5).

TABLE II

| | Scribe Creepage (mm) in 120 h | | | |
|---|---|---|---|---|
| Example | High Solids Alkyd | Polyester | Epoxy | Alkyd |
| 1 | 2–3[1] | 3–3 | 4–4 | 0–1 |
| * | | | | |
| 5 | 5–8 | 5–8 | 10 | 1–1 |
| 6 | 5–5 | 10 | 10 | 5–8 |
| 7 | 5–5 | 5–5 | 5–5 | 0–2 |
| 8 | 10 | 10 | 10 | 4–4 |
| 9 | 10 | 10 | 10 | 4–4 |
| 10 | 0–2 | 0 | 0 | 0 |
| 11 | 0 | 0 | 0 | 0 |
| 12 | 10 | 10 | 10 | 5 |

[1]Numbers in a range refer to minimum and maximum scribe creepage.
*Ex. 2–4 were deemed unacceptable due to precipitation and thus were not subjected to the salt spray test.

The terms and expressions which have been employed are used as terms of description and not of limitation, and there is no intention in the use of such terms and expressions of excluding any equivalents of the features shown and described, or portions thereof, but it is recognized that various modifications are possible within the scope of the invention claimed.

I claim:

1. A composition of matter, useful for treating a conversion coated metal surface to provide enhanced siccative coating adhesion and corrosion resistance properties thereto, comprising an aqueous solution of:
   (a) about 0.2–300 g/l of 3-aminopropyltriethoxysilane; and
   (b) about 0.01–100 g/l of an organic titanium chelate comprising, as its reactive components, a tetraalkytitanate, a beta-diketone and an alkanolamine, said chelate containing 8.6% titanium and having a specific gravity (25° C./25° C.) of 1.03, a viscosity (cP) at 25° of about 50, a thickening point of less than −25° and a flash point of 13° C. (closed cup), as determined by a Pensky-Martens Closed Tester.

2. A composition of matter as recited in claim 1 wherein said organosilane is present in said solution at a concentration of about 0.2–50 g/l.

3. A composition of matter as recited in claim 2 wherein said organic titanium chelate is present in said solution at a concentration of about 0.01–20 g/l.

4. A composition of matter as recited in claim 3 wherein said organosilane is present in said solution at a concentration of about 2.0–5.0 g/l.

5. A composition of matter as recited in claim 4 wherein said organic titanium chelate is present in said solution at a concentration of about 0.05–10 g/l.

6. A composition of matter consisting essentially of an aqueous solution of:
   (a) about 8 w/o 3-aminopropyltriethoxysilane; and
   (b) about 1 w/o an organic titanium chelate comprising, as its reactive components, a tetraalkyltitanate, a beta-diketone and an alkanolamine, said chelate containing 8.6% titanium and having a specific gravity (25° C./25° C.) of 1.03, a viscosity (cP) at 25° C. of about 50, a thickening point of less than −25° C. and a flash point of 13° C. (closed cup), as determined by a Pensky-Martens Closed Tester.

7. A method of imparting enhanced siccative coating adhesion and corrosion resistance properties to a conversion coated metal surface by contacting said surface with a composition of matter comprising an aqueous solution of:
   (a) about 0.2–50 g/l of 3-aminopropyltriethoxysilane; and
   (b) about 0.01–20 g/l of an organic titanium chelate comprising, as its reactive components, a tetraalkyltitanate, a beta-diketone and an alkanolamine, said chelate containing 8.6% titanium and having a specific gravity (25° C./25° C.) of 1.03, a viscosity (cP) at 25° C. and a flash point of 13° C. (closed cup), as determined by a Pensky-Martens Closed Tester.

8. A method as recited in claim 7 wherein said organosilane is present in said solution at a concentration of about 2.0–5.0 g/l.

9. A method as recited in claim 8 wherein said organic titanium chelate is present in said solution at a concentration of about 0.05–10 g/l.

* * * * *

UNITED STATES PATENT AND TRADEMARK OFFICE

CERTIFICATE OF CORRECTION

PATENT NO. : 5,053,081

DATED : October 1, 1991

INVENTOR(S) : Savarimuthu M. Jacob

It is certified that error appears in the above-identified patent and that said Letters Patent is hereby corrected as shown below:

Column 4, line 31, insert a parenthesis --)-- after "alcohol".

Column 8, Claim 7, line 48, after "25°C" insert --of about 50, a thickening point of less than -25°C--.

Signed and Sealed this

Fourteenth Day of June, 1994

*Attest:*

*Attesting Officer*

Bruce Lehman

BRUCE LEHMAN

*Commissioner of Patents and Trademarks*